US009631527B2

(12) United States Patent
Hayama

(10) Patent No.: US 9,631,527 B2
(45) Date of Patent: Apr. 25, 2017

(54) EXHAUST SYSTEM

(71) Applicant: HONDA MOTOR CO., LTD., Tokyo (JP)

(72) Inventor: Yoshitaka Hayama, Kikuchi-gun (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/097,594

(22) Filed: Apr. 13, 2016

(65) Prior Publication Data

US 2016/0312674 A1 Oct. 27, 2016

(30) Foreign Application Priority Data

Apr. 23, 2015 (JP) ..... 2015-088399

(51) Int. Cl.
*F01N 1/08* (2006.01)
*F01N 13/18* (2010.01)

(52) U.S. Cl.
CPC ..... *F01N 1/089* (2013.01); *F01N 1/084* (2013.01); *F01N 13/1805* (2013.01); *F01N 2490/08* (2013.01); *F01N 2590/04* (2013.01)

(58) Field of Classification Search
CPC .. F01N 1/089; F01N 13/1844; F01N 2470/02; F01N 2470/04; F01N 2590/04; F01N 2490/02; F01N 2490/08
USPC ..... 181/227, 228, 251, 253, 254, 265, 268, 181/272, 275
See application file for complete search history.

(56) References Cited

U.S. PATENT DOCUMENTS 2,182,405 A * 12/1939 Noblitt ..... F01N 1/06 181/265
2,960,179 A * 11/1960 Bryant ..... F01N 1/06 181/275
3,042,138 A * 7/1962 Reinert ..... F01N 1/083 181/241
4,192,401 A * 3/1980 Deaver ..... F01N 1/02 181/266

(Continued)

FOREIGN PATENT DOCUMENTS

JP 2007-205347 A 8/2007

*Primary Examiner* — Jeremy Luks
(74) *Attorney, Agent, or Firm* — Drinker Biddle & Reath LLP

(57) ABSTRACT

A first connection pipe, which penetrates a partition wall, and extends to a second expansion chamber side from inside a first expansion chamber, and a second connection pipe, which extends to an exhaust outlet side from the partition wall inside the second expansion chamber are provided; first outer periphery connection holes, which allow exhaust gas from an exhaust pipe to flow out to the second expansion chamber, are formed in the outer peripheral surface of the first connection pipe; second outer periphery connection holes which allow the exhaust gas having flowed out to the second expansion chamber through the first outer periphery connection holes to flow into the second connection pipe, are formed in the outer peripheral surface of the second connection pipe; the first connection pipe and the second connection pipe are arranged such that they are partially parallel to each other; and the first outer periphery connection holes are arranged closer to the exhaust outlet side than the second outer periphery connection holes.

5 Claims, 6 Drawing Sheets

(56) References Cited

U.S. PATENT DOCUMENTS

| | | | | | |
|---|---|---|---|---|---|
| 4,235,304 | A * | 11/1980 | Suyama | F01N 1/02 | 181/265 |
| 4,360,076 | A * | 11/1982 | Suyama | F01N 1/06 | 181/265 |
| 4,673,058 | A * | 6/1987 | Roberts | F01N 1/02 | 181/256 |
| 5,579,577 | A * | 12/1996 | Preslicka | F01N 1/084 | 29/428 |
| 5,959,263 | A * | 9/1999 | Foltz, Jr. | F01N 1/084 | 181/236 |
| 6,412,596 | B1 * | 7/2002 | Brandt | F01N 1/04 | 181/252 |
| 8,201,660 | B2 * | 6/2012 | Han | F01N 1/083 | 181/237 |
| 8,418,805 | B1 * | 4/2013 | Han | F01N 13/1888 | 181/212 |
| 2005/0224283 | A1 * | 10/2005 | Yokoi | F01N 1/06 | 181/268 |
| 2009/0000862 | A1 * | 1/2009 | Buell | F01N 1/083 | 181/212 |
| 2012/0055734 | A1 * | 3/2012 | Miike | F01N 1/084 | 181/226 |
| 2012/0305330 | A1 * | 12/2012 | Kainuma | F01N 1/083 | 181/228 |

* cited by examiner

EXHAUST SYSTEM

CROSS-REFERENCE TO RELATED APPLICATION

Priority is claimed on Japanese Patent Application No. 2015-088399, filed on Apr. 23, 2015, the contents of which are incorporated herein by reference.

BACKGROUND OF THE INVENTION

Field of the Invention

The present invention relates to an exhaust system.

Description of Related Art

Conventionally, there has been an exhaust system disclosed in Japanese Patent Application Publication No. 2007-205347, for example. In this configuration, a partition for partitioning a conduit, which penetrates an expansion chamber inside a muffler, into upstream and downstream sections is provided; outflow holes allowing exhaust gas from the exhaust pipe to flow out to the expansion chamber are formed, in an outer peripheral surface of the upstream section of the conduit that faces the inside of the expansion chamber; and inflow holes allowing the exhaust gas having flowed out to the expansion chamber to flow into the downstream section are formed, in an outer peripheral surface of the downstream section of the conduit that faces the inside of the expansion chamber. In Japanese Patent Application Publication No. 2007-205347, the exhaust gas from the engine flows into the upstream section of the conduit from the exhaust pipe, flows out to the expansion chamber through the outflow holes in the upstream section, then flows into the downstream section through the inflow holes in the downstream section, and is finally discharged to the outside from the downstream end of the conduit.

SUMMARY OF THE INVENTION

However, since the configuration includes the single conduit extending in the longitudinal direction from the exhaust pipe side to the exhaust outlet side, the longitudinal length of the conduit is increased, which causes a problem of enlargement of the muffler. On the other hand, if the longitudinal length of the conduit is shortened to reduce the size of the muffler, it becomes difficult to ensure capacity of the expansion chamber, and therefore exhaust gas cannot be mixed sufficiently. This causes a problem that the exhaust noise-deadening effect cannot be exerted to the fullest.

In view of the foregoing, an objective of the present invention is to downsize a muffler while allowing it to fully exert an exhaust noise-deadening effect, in an exhaust system including the muffler, which extends from the side of an exhaust pipe that guides exhaust gas of an engine, to the side of an exhaust outlet that discharges the exhaust gas to the outside.

As means for solving the above problem, an exhaust system (30) according to an aspect of the present invention comprises a muffler (50), which is connected to an exhaust pipe (40) guiding exhaust gas of an engine (10), and which extends from the exhaust pipe (40) side to the side of an exhaust outlet (52*e*) discharging the exhaust gas to the outside, the muffler (50) including a tube (60), which extends between the exhaust pipe (40) side and the exhaust outlet (52*e*) side, and in which an expansion chamber (S) is formed, characterized in that: the muffler (50) further includes a partition wall (54) for partitioning the inside of the tube (60); the partition wall (54) divides the expansion chamber (S) into a first expansion chamber (S1) on the exhaust pipe (40) side, and a second expansion chamber (S2) on the exhaust outlet (52*e*) side; the muffler (50) further includes a first connection pipe (51), which is arranged so as to penetrate the partition wall (54) and extend to the second expansion chamber (S2) side from inside the first expansion chamber (S1), and a second connection pipe (52), which is arranged so as to extend to the exhaust outlet (52*e*) side from the partition wall (54) inside the second expansion chamber (S2); a first outer periphery connection hole (51*h*), which allows the exhaust gas from the exhaust pipe (40) to flow out to the second expansion chamber (S2), is formed in the outer peripheral surface of the first connection pipe (51) that faces the second expansion chamber (S2); a second outer periphery connection hole (52*h*), which allows the exhaust gas having flowed out to the second expansion chamber (S2) through the first outer periphery connection hole (51*h*) to flow into the second connection pipe (52), is formed in the outer peripheral surface of the second connection pipe (52) that faces the second expansion chamber (S2); the first connection pipe (51) and the second connection pipe (52) are arranged such that they are at least partially parallel to each other; and the first outer periphery connection hole (51*h*) is arranged closer to the exhaust outlet (52*e*) side than the second outer periphery connection hole (52*h*).

In the above mentioned exhaust system, an end part of the second connection pipe (52) on the exhaust pipe (40) side is pressed against the partition wall (54); and a third connection hole (56*h*), which allows the exhaust gas having flowed out to the first expansion chamber (S1) from the exhaust pipe (40) to flow into the second connection pipe (52), is formed in the partition wall (54).

In the above mentioned exhaust system, a distal aperture (51*u*) of the first connection pipe (51) on the exhaust pipe (40) side, allows the exhaust gas having flowed out to the first expansion chamber (S1) from the exhaust pipe (40) to flow into the first connection pipe (51); the distal aperture (51*u*) is arranged closer to the exhaust pipe (40) side than the third connection hole (56*h*); and the first outer periphery connection hole (51*h*) is arranged in the second expansion chamber (S2).

In the above mentioned exhaust system, a lid member (53), which closes a distal aperture (51*e*) of the first connection pipe (51) on the exhaust outlet (52*e*) side, at a position closer to the exhaust outlet (52*e*) side than the first outer periphery connection hole (51*h*), is provided in an end part of the first connection pipe (51) on the exhaust outlet (52*e*) side.

In the above mentioned exhausted system, the first connection pipe (51) and the second connection pipe (52) have cylindrical shapes; and an inner diameter (D1) of the first connection pipe (51) is the same or smaller than an inner diameter (D2) of the second connection pipe (52).

In the above mentioned exhaust system, an opening area (E2) of the second outer periphery connection hole (52*h*) is the same or smaller than an opening area (E1) of the first outer periphery connection hole (51*h*).

According to the above mentioned exhaust system of the present application, the first connection pipe and the second connection pipe are arranged such that they are at least partially parallel to each other. Hence, increase in the longitudinal length of the muffler can be avoided, as compared to a configuration where a single conduit extends in the longitudinal direction from the exhaust pipe side to the exhaust outlet side. Therefore, the muffler can be downsized. Additionally, the first outer periphery connection hole is arranged closer to the exhaust outlet than the second outer periphery connection hole. Since the exhaust gas having flowed out to the inside of the expansion chamber through the first outer periphery connection hole, has inertia to flow to the exhaust outlet side, the exhaust gas having flowed out to the inside of the expansion chamber is more likely to remain inside the expansion chamber. Hence, exhaust gas can be mixed sufficiently, and the exhaust noise-deadening effect can be fully exerted. Accordingly, the muffler can be downsized, and its exhaust noise-deadening effect can be fully exerted. Also, the partition wall divides the expansion chamber into the first expansion chamber on the exhaust pipe side, and the second expansion chamber on the exhaust outlet side; and the first connection pipe is arranged so as to penetrate the partition wall, and extend to the second expansion chamber side from inside the first expansion chamber. Since exhaust gas can be mixed in both of the first expansion chamber and the second expansion chamber, exhaust noise can be deadened more effectively, as compared to a configuration including only a single expansion chamber.

Also, the second connection pipe is arranged so as to extend to the exhaust outlet side from the partition wall, inside the second expansion chamber. Hence, increase in the longitudinal length of the muffler inside the second expansion chamber can be avoided, so that the muffler can be downsized. Also, downsizing of the muffler inside the second expansion chamber makes it easier to ensure capacity of the first expansion chamber. Therefore, the exhaust gas having flowed out to the inside of the first expansion chamber from the exhaust pipe is more likely to remain inside the first expansion chamber, exhaust gas can be mixed sufficiently, and exhaust noise can be deadened effectively.

According to the above mentioned exhaust system of the present application, the end part of the second connection pipe on the exhaust pipe side is pressed against the partition wall; and the third connection hole, which allows the exhaust gas having flowed out to the first expansion chamber from the exhaust pipe to flow into the second connection pipe, is formed in the partition wall. Hence, the exhaust gas having flowed into the second connection pipe through the third connection hole, and the exhaust gas having flowed into the second connection pipe through the second outer periphery connection hole are allowed to interfere with each other, so that exhaust noise can be deadened effectively.

According to the above mentioned exhaust system of the present application, the distal aperture of the first connection pipe on the exhaust pipe side allows the exhaust gas having flowed out to the first expansion chamber from the exhaust pipe to flow into the first connection pipe; and the distal aperture is arranged closer to the exhaust pipe side than the third connection hole. Hence, the exhaust gas having flowed out to the inside of the first expansion chamber from the exhaust pipe is more likely to flow into the distal aperture than into the third connection hole. Also, since the first outer periphery connection hole is arranged in the second expansion chamber, the exhaust gas having flowed into the distal aperture passes through the first connection pipe, and flows out to the second expansion chamber through the first outer periphery connection hole. Accordingly, exhaust gas can be mixed sufficiently by using the second expansion chamber effectively, and exhaust noise can be deadened effectively.

According to the above mentioned exhaust system of the present application, the lid member, which closes the distal aperture of the first connection pipe on the exhaust outlet side, at a position closer to the exhaust outlet side than the first outer periphery connection hole, is provided in the end part of the first connection pipe on the exhaust outlet side. Hence, the exhaust gas having flowed into the first connection pipe from the exhaust pipe flows out to the expansion chamber, while passing through only the first outer periphery connection hole. Accordingly, exhaust gas can be mixed sufficiently by using the expansion chamber effectively, and exhaust noise can be deadened effectively.

According to the above mentioned exhaust system of the present application, the first connection pipe and the second connection pipe have cylindrical shapes; and the inner diameter of the first connection pipe is the same or smaller than the inner diameter of the second connection pipe. Hence, the flow speed of exhaust gas flowing through the first connection pipe can be made faster than a case where the inner diameter of the first connection pipe is larger than the inner diameter of the second connection pipe. Therefore, the exhaust gas having flowed into the first connection pipe from the exhaust pipe is more likely to flow out to the expansion chamber through the first outer periphery connection hole. Accordingly, exhaust gas can be mixed sufficiently by using the expansion chamber effectively, and exhaust noise can be deadened effectively.

According to the above mentioned exhaust system of the present application, the opening area of the second outer periphery connection hole is smaller than the opening area of the first outer periphery connection hole. Hence, the exhaust gas having flowed out to the expansion chamber through the first outer periphery connection hole is less likely to flow into the second connection pipe, as compared to a case where the opening area of the second outer periphery connection hole is larger than the opening area of the first outer periphery connection hole. Therefore, the exhaust gas having flowed out to the inside of the expansion chamber is more likely to remain inside the expansion chamber. Accordingly, exhaust gas can be mixed sufficiently by using the expansion chamber effectively, and exhaust noise can be deadened effectively.

DESCRIPTION OF EMBODIMENTS

Hereinafter, an embodiment of the present invention will be described with reference to the drawings. Note that in the following description, directions such as front and rear, and left and right are the same as those of a vehicle described below, if not stated otherwise. Also, an arrow FR indicating the front of the vehicle, an arrow LH indicating the left of the vehicle, and an arrow UP indicating the upper direction of the vehicle are shown, in appropriate parts of the drawings used in the following description.

<Whole Vehicle>

Figure 1:
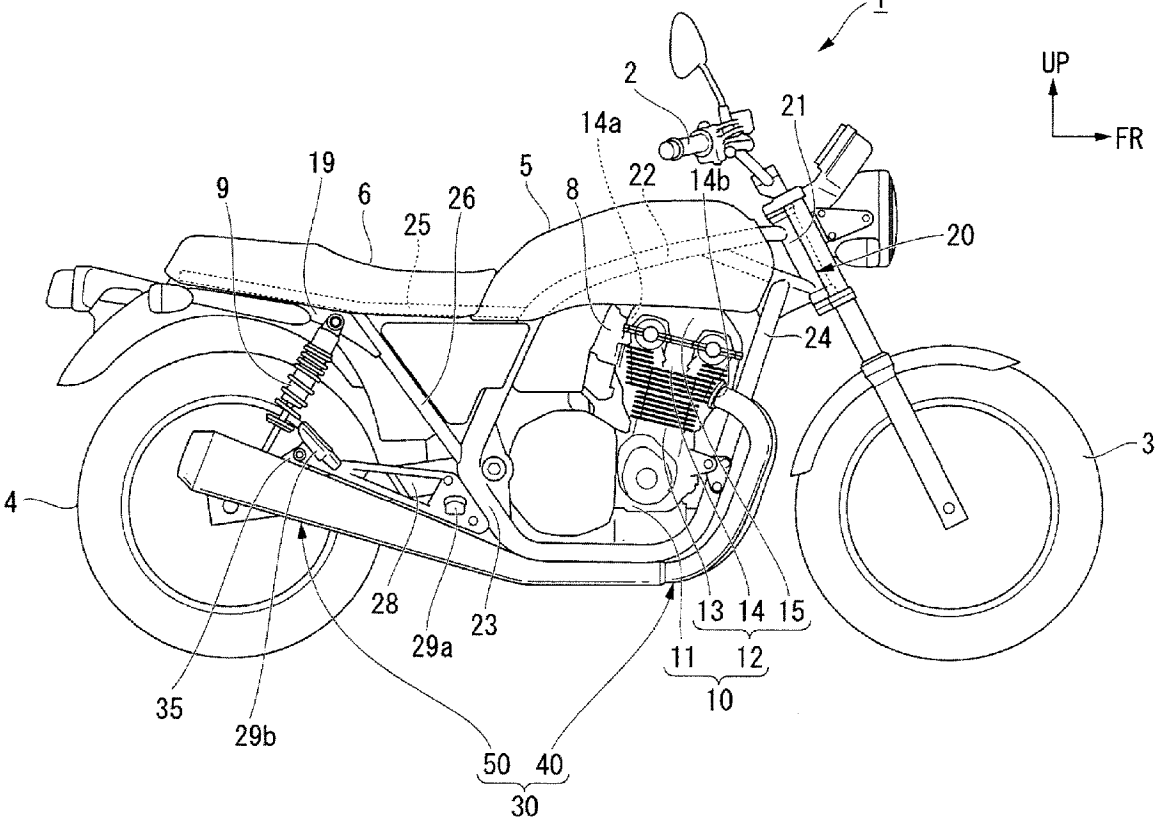
FIG. 1 is a right side view of a motorcycle of an embodiment of the present invention.
Figure 2:
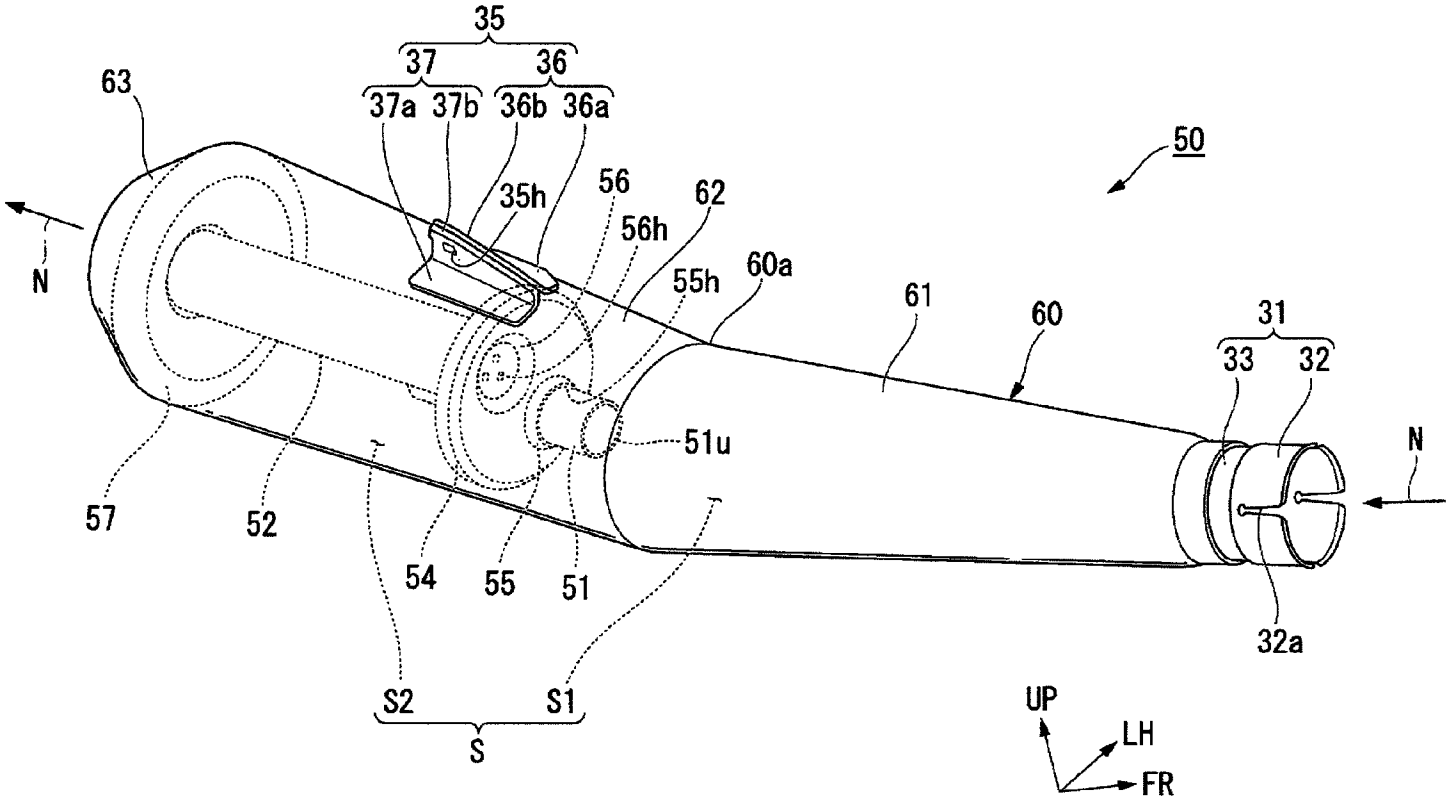
FIG. 2 is a perspective view of an exhaust system of the aforementioned motorcycle, as seen from the upper right direction.
Figure 3:
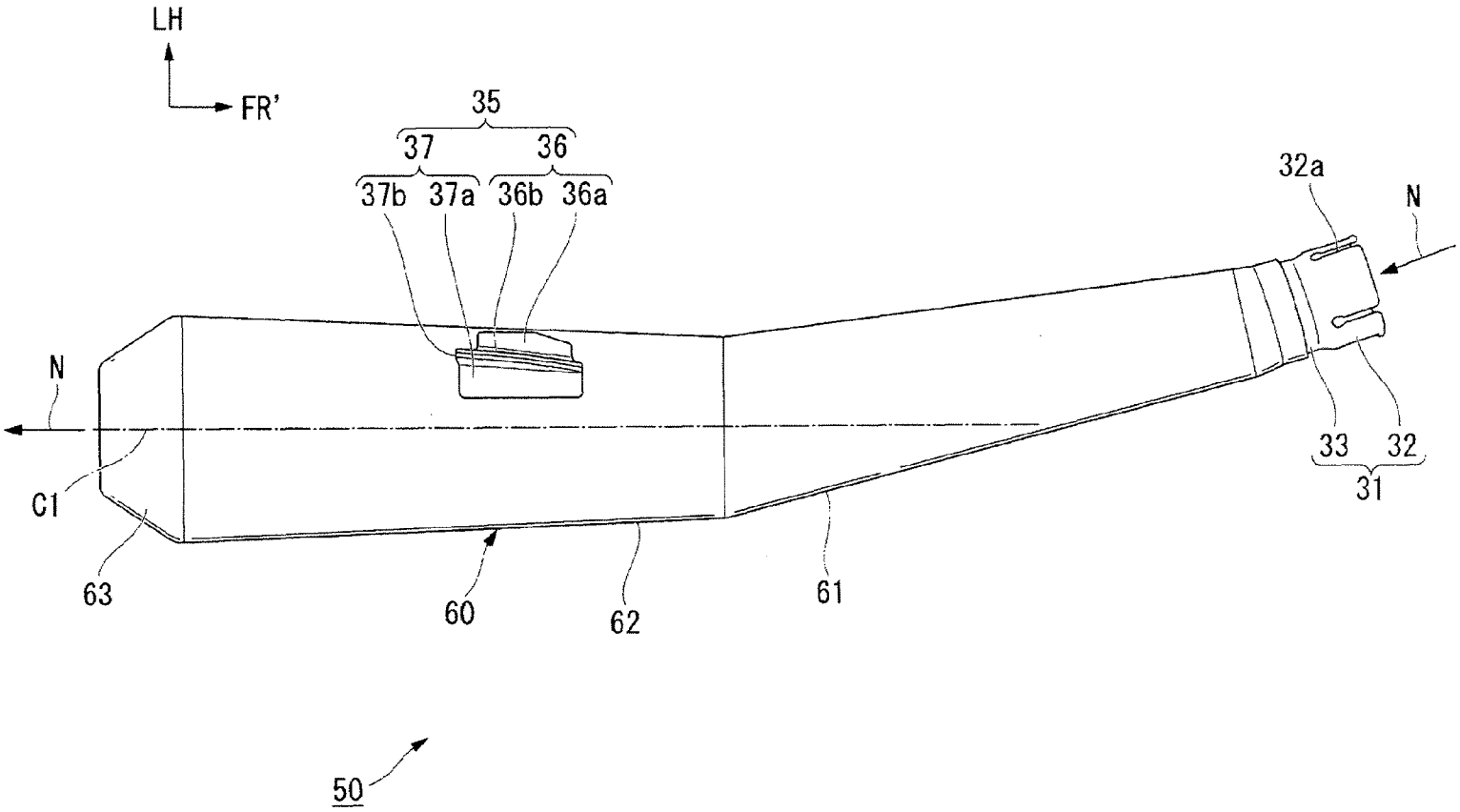
FIG. 3 is a top view of the aforementioned exhaust system.
Figure 4:
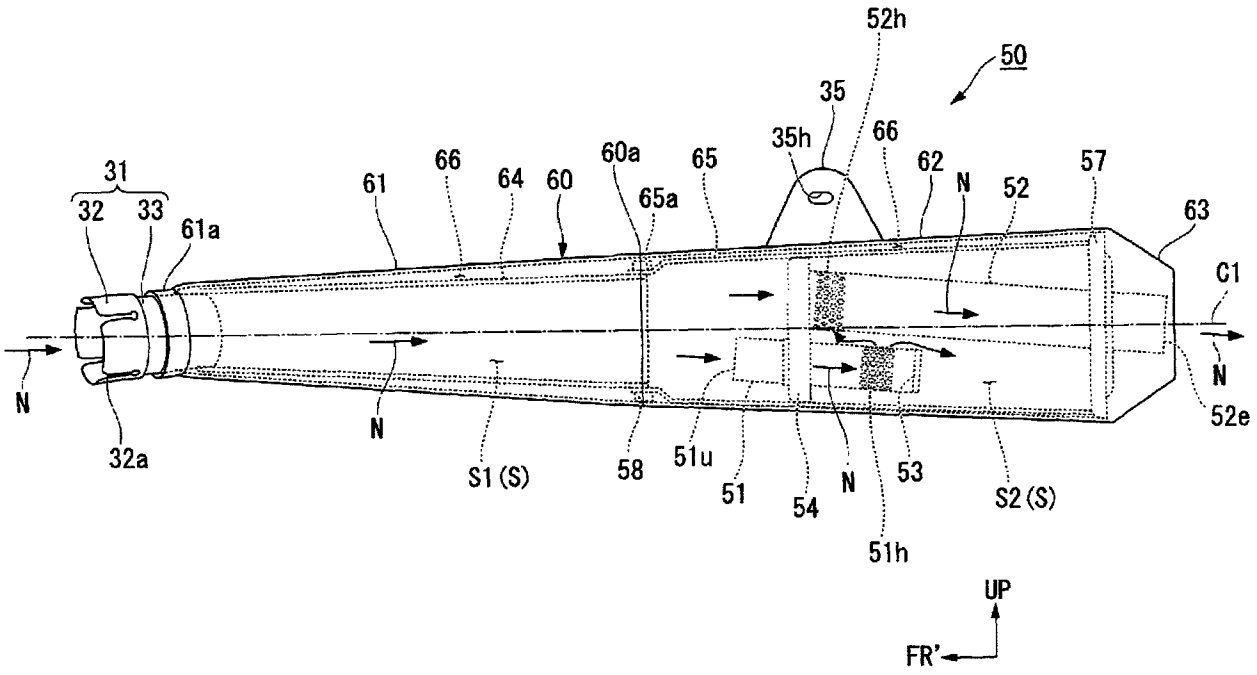
FIG. 4 is a left side view of the aforementioned exhaust system.

FIG. 1 is a right side view of a motorcycle 1 as an example of a straddle type vehicle. Referring to FIG. 1, the motorcycle 1 includes a bar handle 2, a front wheel 3 steered by the bar handle 2, a rear wheel 4 arranged in a rear end part of a swing arm 28, and an engine 10 arranged between the front wheel 3 and the rear wheel 4. Steering system parts including the bar handle 2 and the front wheel 3 are rotatably supported to a head pipe 21, at the front end of a body frame 20. A front end part of the swing arm 28 is swingably supported to the body frame 20.

The body frame 20 is formed by joining multiple kinds of steel materials into one body, by welding or other methods. The body frame 20 includes the head pipe 21, a main frame 22 extending downward in the rear direction from the head pipe 21, a pivot frame 23 attached to a rear end part of the main frame 22, a down frame 24 extending downward in the rear direction from the head pipe 21 at a steeper angle than the main frame 22, a seat rail 25 welded to a rear part of the main frame 22, and a rear stay 26 arranged below the seat rail 25.

The engine 10 includes a crankcase 11 accommodating a crankshaft and a gearshift mechanism (none are shown), and a cylinder 12 connected to a front upper end part of the crankcase 11. The cylinder 12 protrudes toward the front upper direction from the front upper end part of the crankcase 11. The cylinder 12 includes a cylinder block 13, a cylinder head 14, and a head cover 15, in this order from the crankcase 11 side, in the protruding direction of the cylinder 12.

A piston (not shown) is fitted into the cylinder block 13 so as to be movable in a reciprocating manner. The reciprocating motion of the piston, is converted into rotary movement of the crankshaft inside a front part of the crankcase 11. Rotary power of the crankshaft is outputted to the rear left side of the crankcase 11, through a clutch inside a rear part of the crankcase 11 and a transmission (none are shown), and is transmitted to the rear wheel 4 through a chain-type power train (not shown).

The rear wheel 4 is supported to the rear end part of the swing arm 28. A gusset 19 is provided in a connection part between the seat frame 25 and the rear stay 26. A cushion unit 9 for cushioning vertical movement of the rear wheel 4 is provided, on the side of the rear wheel 4. The cushion unit 9 connects the rear end part of the swing arm 28 and the gusset 19.

A fuel tank 5 for supplying fuel to the engine 10, is supported to an upper part of the main frame 22. A tandem seat 6 on which a rider and a passenger sits, is arranged behind the fuel tank 5. The seat 6 is supported to the seat frame 25.

An intake port 14*a* for supplying a mixture of fuel and combustion air is opened, in a rear face of the cylinder head 14. A carburetor 8 is connected to the intake port 14*a*, through an insulator (not shown). The carburetor 8 includes a carburetor and a throttle part. An air cleaner is connected through a connecting tube (none are shown), to the upstream side of intake of the carburetor 8.

An exhaust port 14*b* for discharging exhaust gas is opened, in a front face of the cylinder head 14. An exhaust pipe 40 of an exhaust system 30 is connected to the exhaust port 14*b*. The exhaust pipe 40 extends frontward from the front face of the cylinder head 14, and then curves around front and lower faces of the crankcase 11 and extends rearward. A rear end part of the exhaust pipe 40 is connected to a muffler 50, which is positioned on both left and right sides of the rear wheel 4. Although not shown, a cross-sectional shape, which is obtained by cutting the exhaust pipe 40 in a direction perpendicular to the extending direction of the exhaust pipe 40, is an annular shape.

Note that in FIG. 1, reference numeral 29*a* indicates a main step for the rider to place his/her foot, and reference numeral 29*b* indicates a pillion step for the passenger to place his/her foot.

<Muffler (Exhaust System)>

Hereinafter, details of the muffler 50 constituting the exhaust system 30 will be described, with reference to FIGS. 2 to 6. Note that in the drawings, arrows N indicate the flow of exhaust gas in the muffler 50.

The muffler 50 extends from the side of the exhaust pipe 40 that guides exhaust gas of the engine 10, to the side of an exhaust outlet 52*e* that discharges the exhaust gas to the outside. The muffler 50 is formed into a tube shape, which extends linearly, while being inclined upward in the rear direction with respect to the horizontal direction. The muffler 50 absorbs noise in the exhaust gas. In the drawings, arrows FR' indicate the front in the axial direction of the tube shape of the muffler 50 (muffler axis direction), and arrows UP' indicate the upper direction perpendicular to the muffler axis direction. Note that the muffler axis direction is equivalent to a later-mentioned center axis C1.

The muffler 50 extends between the exhaust pipe 40 side and the exhaust outlet 52*e* side, and includes a cylindrical tube 60 in which an expansion chamber S is formed, a first connection pipe 51 extending into the expansion chamber S from the exhaust pipe 40 side, and a second connection pipe 52 extending to the exhaust outlet 52*e* side from inside the expansion chamber S.

<Tube>

The tube 60 has a double-pipe structure including a first outer pipe 61 and a second outer pipe 62, which form the exterior of the tube 60, and a first inner pipe 64 and a second inner pipe 65, which form an exhaust passage on the inside in the radial direction of the first outer pipe and the second outer pipe. In side view of FIG. 4, the tube 60 extends in the longitudinal direction such that its diameter enlarges toward the rear. The space on the inner side in the radial direction of the first inner pipe 64 and the second inner pipe 65 is the expansion chamber S. Note that in the drawings, reference numeral C1 indicates a center axis passing through the radial center of the second outer pipe 62.

The first outer pipe 61 and the first inner pipe 64 are positioned on the front side of the tube 60, while the second outer pipe 62 and the second inner pipe 65 are positioned on the rear side of the tube 60. The outer diameter of a rear end part of the first outer pipe 61 is substantially the same size as the outer diameter of a front end part of the second outer pipe 62. For example, the rear end part of the first outer pipe 61 is welded to the front end part of the second outer pipe 62, with the rear end part of the first outer pipe 61 pressed against the front end part of the second outer pipe 62. In the drawings, reference numeral 60*a* indicates a welding part (hereinafter referred to as "joint portion") between the rear end part of the first outer pipe 61 and the front end part of the second outer pipe 62.

Figure 6:
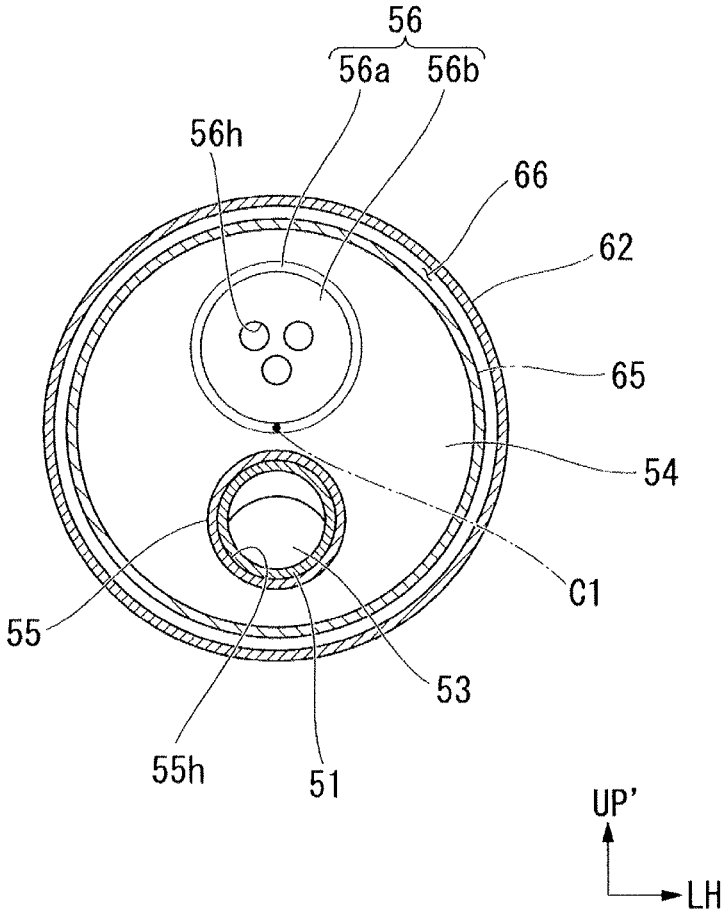
FIG. 6 is a cross-sectional view taken along VI-VI of FIG. 5.

The first outer pipe 61, the second outer pipe 62, the first inner pipe 64, and the second inner pipe 65 have annular shapes in cross-sectional view (see FIG. 6 for the second outer pipe 62 and the second inner pipe 65). A gap 66 is formed between the inner peripheral surface of the first outer pipe 61 and the outer peripheral surface of the first inner pipe 64, and between the inner peripheral surface of the second outer pipe 62 and the outer peripheral surface of the second inner pipe 65.

The outer diameter of the rear end part of the first inner pipe 64 is substantially the same size as the inner diameter of the front end part of the second inner pipe 65. A narrowed portion 65*a* having a smaller outer diameter than the rear side is formed, in the front end part of the second inner pipe 65. The inner diameter of the narrowed portion 65*a* is substantially the same size as the outer diameter of the rear end part of the first inner pipe 64. For example, the rear end part of the first inner pipe 64 is welded to the narrowed portion 65*a* of the second inner pipe 65, with the rear end part of the first inner pipe 64 inserted into the narrowed portion 65*a* of the second inner pipe 65.

A ring-shaped annular member 58 is provided between the narrowed portion 65*a* of the second inner pipe 65, and the joint portion 60*a*. The annular member 58 is arranged so as to fill in the gap 66 between the narrowed portion 65*a* and the joint portion 60*a*. The annular member 58 is welded to the narrowed portion 65*a* and the joint portion 60*a*.

A connection portion 31 is provided in a front end part of the first outer pipe 61. The connection portion 31 includes, as one body, a first connection portion 32 and a second connection portion 33, in this order from the front side.

The first connection portion 32 is formed into a cylindrical shape having an outer diameter, which is substantially the same as the inner diameter of the rear end part of the exhaust pipe 40. The first connection portion 32 has multiple (such as four in the embodiment) cutouts 32*a*, which extend rearward from the front end. The first connection portion 32 is fixed to the rear end part of the exhaust pipe 40.

The second connection portion 33 has a smaller outer diameter than the outer diameter of the first connection portion 32, is formed in to a cylindrical shape having an outer diameter, which is substantially the same as the inner diameter of the front end part of the first outer pipe 61 and the inner diameter of the front end part of the first inner pipe 64, and is formed into a cylindrical shape extending rearward from the rear end of the first connection portion 32. A reduced-diameter portion 61*a* having a smaller inner diameter than the rear side is formed, in the front end part of the first outer pipe 61.

The inner diameter of the reduced-diameter portion 61*a* is substantially the same size as the inner diameter of the first inner pipe 64, and is substantially the same size as the outer diameter of the second connection portion 33. For example, the second connection portion 33 of the connection portion 31 is welded to the reduced-diameter portion 61*a* of the first outer pipe 61, with the second connection portion 33 of the connection portion 31 inserted into the reduced-diameter portion 61*a* of the first outer pipe 61, and the front end part of the first inner pipe 64.

An end plate 57 closing the expansion chamber S is connected, to rear end parts of the second outer pipe 62 and the second inner pipe 65. The end plate 57 is formed into a circular plate, which is substantially the same size as the inner diameter of the rear end part of the second outer pipe 62. The rear end parts of the second outer pipe 62 and the second inner pipe 65 are welded to the end plate 57. For example, after welding the rear end part of the second inner pipe 65 to the end plate 57, the end plate 57 is welded to the rear end part of the second outer pipe 62, with the end plate 57 inserted into the rear end part of the second outer pipe 62.

An end cap 63, which is tapered toward the rear, is connected to the rear end part of the second outer pipe 62. A front end part of the end cap 63 is formed into a ring shape having substantially the same outer diameter as the diameter of the rear end part of the second outer pipe 62. For example, the front end part of the end cap 63 is welded to the rear end part of the second outer pipe 62, with the front end part of the end cap 63 pressed against the rear end part of the second outer pipe 62.

A stay 35 for supporting the muffler 50 is provided, in an outer peripheral part of the second outer pipe 62. In top view of FIG. 3, the stay 35 is arranged on the left side of the center axis C1, in an upper part of the second outer pipe 62. In left side view of FIG. 4, the stay 35 is formed into a triangular shape protruding upward.

The stay 35 includes a first stay 36 and a second stay 37, which are bent into an L shape.

The first stay 36 includes, as one body, a first base portion 36*a* formed into a plate, which extends along the outer peripheral surface of the second outer pipe 62, and has a thickness in the thickness direction of the second outer pipe 62; and a first standing portion 36*b* standing up from the right end of the first base portion 36*a*.

The second stay 37 is arranged adjacent to, and on the right side of the first stay 36. The second stay 37 includes, as one body, a second base portion 37*a* formed into a plate, which extends along the outer peripheral surface of the second outer pipe 62, and has a thickness in the thickness direction of the second outer pipe 62; and a second standing portion 37*b* standing up from the left end of the second base portion 37*a*. The first base portion 36*a* and the second base portion 37*a* are welded to the outer peripheral surface of the second outer pipe 62. The first standing portion 36*b* and the second standing portion 37*b* are welded so as to overlap each other, in left side view of FIG. 4.

The first standing portion 36*b* and the second standing portion 37*b* have a long hole 35*h*, which is opened in the thickness direction and extends in the longitudinal direction. For example, the muffler 50 is fixed to the vehicle body side through the stay 35 (see FIG. 1), by inserting a fastening member such as a bolt into the long hole 35*h* in the stay 35, and screwing and tightening it into a nut provided in a supporting member on the vehicle body side. Since the stay 35 is provided near the pillion step 29*b* (see FIG. 1), load of the passenger can be received in a position where rigidity of the vehicle body is improved.

<Partition Wall>

The muffler 50 further includes a circular plate-shaped partition wall 54 for partitioning the inside of the tube 60. The partition wall 54 is arranged inside the second inner pipe 65. The partition wall 54 divides the expansion chamber S into a first expansion chamber S1 on the exhaust pipe 40 side, and a second expansion chamber S2 on the exhaust outlet 52*e* side.

In cross-sectional view of FIG. 6, the partition wall 54 includes, as one body, a cylindrical boss portion 55 in which a circular insertion hole 55*h* for inserting the first connection pipe 51 is formed; and a circular connection portion 56 to which a front end part of the second connection pipe 52 is connected. In cross-sectional view of FIG. 6, the boss portion 55 is arranged lower than the center axis C1. In cross-sectional view if FIG. 6, the connection portion 56 is arranged above the center axis, such that the lower end overlaps with the center axis C1.

The diameter of the insertion hole 55*h* is substantially the same size as the outer diameter of the first connection pipe 51. For example, the first connection pipe 51 is welded to the boss portion 55, with the first connection pipe 51 inserted into the insertion hole 55*h* (a later-mentioned second piping 51*b* protruding further into the second expansion chamber S2 than the partition wall 54).

The diameter of the connection portion 56 is substantially the same size as the outer diameter of the second connection pipe 52. In cross-sectional view of FIG. 6, the connection portion 56 has: a ring-shaped annular portion 56*a*, which has substantially the same shape as the front end part of the second connection pipe 52; and a circular connection portion 56*b*, which is connected on the inner side in the radial direction of the annular portion 56*a*, and in which later-mentioned third connection holes 56*h* are formed. For example, the front end part of the second connection pipe 52 is welded to the annular portion 56*a*, with the front end part of the second connection pipe 52 pressed against the annular portion 56*a*.

<First Connection Pipe>

Figure 5:
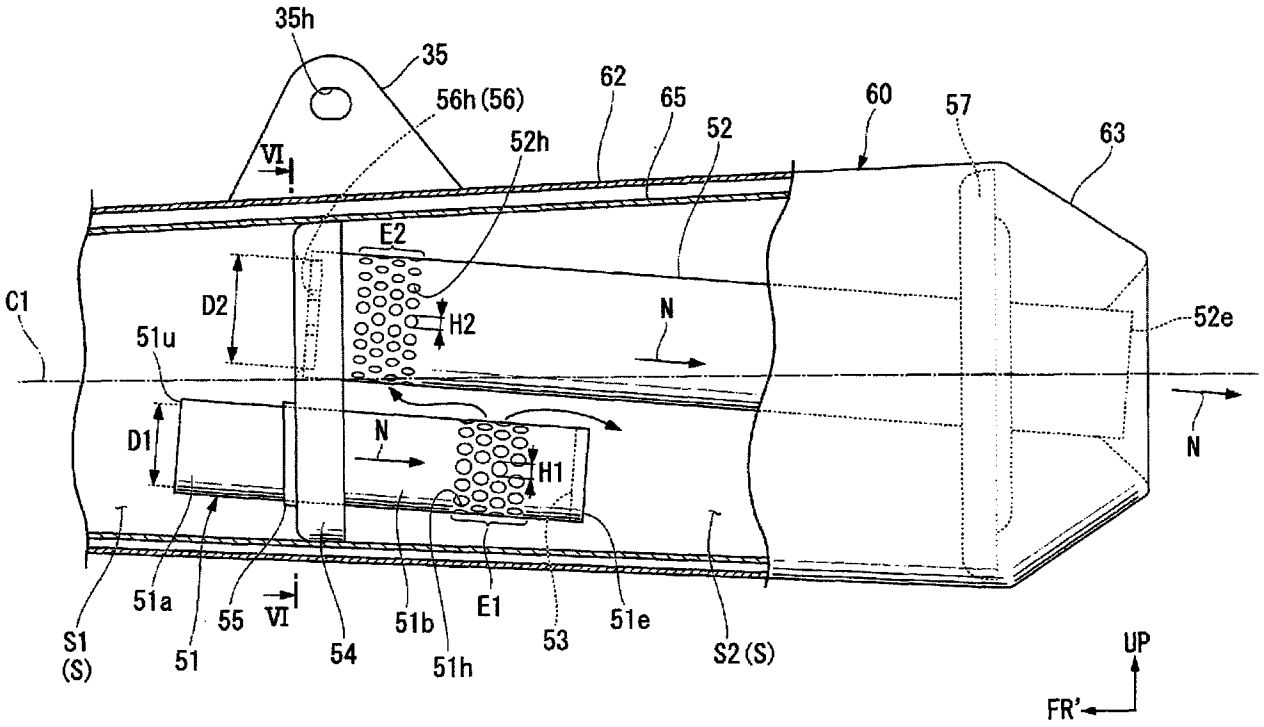
FIG. 5 is an enlarged view of a main part of the aforementioned exhaust system, showing first piping and second piping thereof.

In left side view of FIG. 5, the first connection pipe 51 is formed into a cylindrical shape, which is inclined so as to separate from the center axis C1 toward the rear. In the embodiment, an inner diameter D1 of the first connection pipe 51 is smaller than an inner diameter D2 of the second connection pipe 52 (D1<D2). Note that the inner diameter D1 of the first connection pipe 51 may be the same as the inner diameter D2 of the second connection pipe 52 (D1=D2).

The first connection pipe 51 is arranged so as to pass through the insertion hole 55*h* in the partition wall 54, and extend to the second expansion chamber S2 side from inside the first expansion chamber S1. The first connection pipe 51 includes a first piping 51*a* positioned on the first expansion chamber S1 side, and the second piping 51*b* connected to the rear end of the first piping 51*a* and positioned on the second expansion chamber S2 side.

Here, a protrusion amount of the first connection pipe 51 on the exhaust pipe 40 side of the partition wall 54 is referred to as "longitudinal length of first piping 51*a*," and a protrusion amount of the first connection pipe 51 on the exhaust outlet 52*e* side of the partition wall 54 is referred to as "longitudinal length of second piping 51*b*." The longitudinal length of the second piping 51*b* is larger than the longitudinal length of the first piping 51*a*.

A distal aperture 51*u* (hereinafter referred to as "first opening.") of the first piping 51*a* (first connection pipe 51) on the exhaust pipe 40 side, allows exhaust gas having flowed out to the first expansion chamber S1 from the exhaust pipe 40 to flow into the first connection pipe 51.

Multiple first outer periphery connection holes 51*h*, which allow the exhaust gas (exhaust gas from the exhaust pipe 40) having flowed into the first connection pipe 51 to flow out to the second expansion chamber S2, are formed in the outer peripheral surface of the second piping 51*b* that faces the second expansion chamber S2. In left side view of FIG. 5, the first outer periphery connection holes 51*h* are formed into circular shapes opened in the thickness direction of the second piping 51*b*. For example, the first outer periphery connection holes 51*h* are punched holes, and are arranged in a staggered manner along the circumferential direction of the second piping 51*b*.

A lid member 53, which closes a distal aperture 51*e* (hereinafter referred to as "second opening.") of the second piping 51*b* (first connection pipe 51) on the exhaust outlet 52*e* side, at a position closer to the exhaust outlet 52*e* side than the first outer periphery connection holes 51*h*, is provided in an end part of the second piping 51*b* (first connection pipe 51) on the exhaust outlet 52*e* side. The lid member 53 is formed into a circular plate, which has a thickness in the axial direction of the second piping 51*b*. The outer diameter of the lid member 53 is substantially the same size as the inner diameter of the second opening 51*e*.

Referring to FIG. 6, multiple (such as three in the embodiment) third connection holes 56*h*, which allow the exhaust gas having flowed out to the first expansion chamber S1 from the exhaust pipe 40 to flow into the second connection pipe 52, are formed in the connection portion 56*b* of the partition wall 54. In cross-sectional view of FIG. 6, the third connection holes 56*h* are formed into circular shapes opened in the thickness direction of the connection portion 56*b*.

Also referring to FIG. 5, the first opening 51*u* is arranged closer to the exhaust pipe 40 side than the third connection holes 56*h*.

Here, an area obtained by adding all of the opening areas of the multiple third connection holes 56*h* is referred to as "opening area of third connection holes 56*h*." In the embodiment, the opening area of the third connection holes 56*h* is smaller than the opening area of the first opening 51*u*. Note that the opening area of the connection holes 56*h* may be the same as the opening area of the first opening 51*u*.

<Second Connection Pipe>

In left side view of FIG. 5, the second connection pipe 52 is formed into a cylindrical shape, which is parallel to the axial direction of the first connection pipe 51, and is inclined so as to intersect with the center axis C1. The second connection pipe 52 is arranged so as to extend to the exhaust outlet 52*e* side from the partition wall 54, inside the second expansion chamber S2. The second connection pipe 52 is arranged parallel to the second piping 51*b* of the first connection pipe 51. In other words, the second connection pipe 52 is arranged so as to overlap with the second piping 51*b* of the first connection pipe 51, in the longitudinal direction of the tube 60 (direction along the center axis C1).

Multiple second outer periphery connection holes 52*h*, which allow the exhaust gas having flowed out to the second expansion chamber S2 through the first outer periphery connection holes 51*h* to flow into the second connection pipe 52, are formed in the outer peripheral surface of the second connection pipe 52 that faces the second expansion chamber S2. In left side view of FIG. 5, the second outer periphery connection holes 52*h* are formed into circular shapes opened in the thickness direction of the second connection pipe 52. For example, the second outer periphery connection holes 52*h* are punched holes, and are arranged in a staggered manner along the circumferential direction of the second connection pipe 52.

In left side view of FIG. 5, the first outer periphery connection holes 51*h* are arranged closer to the exhaust outlet 52*e* side than the second outer periphery connection holes 52*h*.

The diameter H2 of the second outer periphery connection hole 52*h* is smaller than the diameter H1 of the first outer periphery connection hole 51*h* (H2<H1). Meanwhile, the arranged number of second outer periphery connection holes 52*h* is larger than the arranged number of the first outer periphery connection holes 51*h*.

Here, the area obtained by adding all of the opening areas of the multiple first outer periphery connection holes 51*h* is referred to as "opening area E1 of first outer periphery connection holes 51*h*," and an area obtained by adding all of the opening areas of the multiple second outer periphery connection holes 52*h* is referred to as "opening area E2 of second outer periphery connection holes 52*h*." In the embodiment, the opening area E2 of second outer periphery connection holes 52*h* is larger than the opening area E1 of first outer periphery connection holes 51*h* (E2>E1). Note that the opening area E2 of second outer periphery connection holes 52*h* may be the same as the opening area E1 of first outer periphery connection holes 51*h* (E2=E1).

The second connection pipe 52 links the second expansion chamber S2 and the outside of the muffler 50, by penetrating the end plate 57. The tail end of the second connection pipe 52 on the end plate 57 side forms the exhaust outlet 52*e*.

Hereinbelow, the flow of exhaust gas in the exhaust system 30 will be described.

Referring to FIG. 1, exhaust gas discharged from the exhaust port 14*b* on the front face of the cylinder head 14 passes through the exhaust pipe 40, and flows toward the muffler 50. Referring to FIGS. 2 to 6, the exhaust gas having passed through the exhaust pipe 40 flows into the first expansion chamber S1. The exhaust gas having flowed into the first expansion chamber S1 flows into the first connection pipe 51 through the first opening 51*u*, flows into the second connection pipe 52 through the third connection holes 56*h*, or remains inside the first expansion chamber S1.

The exhaust gas having flowed into the first opening 51*u* passes through the first connection pipe 51, and flows out to the inside of the second expansion chamber S2 through the first outer periphery connection holes 51*h*. The exhaust gas having flowed out to the inside of the second expansion chamber S2 flows into the second connection pipe 52 through the second outer periphery connection holes 52*h*, or remains in the second expansion chamber S2.

The exhaust gas having flowed into the second connection pipe 52 through the third connection holes 56*h*, and the exhaust gas having flowed into the second connection pipe 52 through the second outer periphery connection holes 52*h* interfere with each other. The interference between the exhaust gas having flowed into the second connection pipe 52 through the third connection holes 56*h*, and the exhaust gas having flowed into the second connection pipe 52 through the second outer periphery connection holes 52*h*, cancels out the kinetic energy of the exhaust gas having flowed into the second connection pipe 52.

The exhaust gas whose kinetic energy has been cancelled out flows rearward along the second connection pipe 52, and is discharged to the outside.

As has been described, the above embodiment is the exhaust system 30 including: the muffler 50, which is connected to the exhaust pipe 40 guiding exhaust gas of the engine 10, and which extends from the exhaust pipe 40 side to the side of the exhaust outlet 52*e* discharging the exhaust gas to the outside, the muffler 50 including the tube 60, which extends between the exhaust pipe 40 side and the exhaust outlet 52*e* side, and in which the expansion chamber S is formed, in which: the muffler 50 further includes the partition wall 54 for partitioning the inside of the tube 60; the partition wall 54 divides the expansion chamber S into the first expansion chamber S1 on the exhaust pipe 40 side, and the second expansion chamber S2 on the exhaust outlet 52*e* side; the muffler 50 further includes the first connection pipe 51, which is arranged so as to penetrate the partition wall 54 and extend to the second expansion chamber S2 side from inside the first expansion chamber S1, and the second connection pipe 52, which is arranged so as to extend to the exhaust outlet 52*e* side from the partition wall 54 inside the second expansion chamber S2; the first outer periphery connection holes 51*h*, which allow exhaust gas from the exhaust pipe 40 to flow out to the second expansion chamber S2, are formed in the outer peripheral surface of the first connection pipe 51 that faces the second expansion chamber S2; the second outer periphery connection holes 52*h*, which allow the exhaust gas having flowed out to the second expansion chamber S2 through the first outer periphery connection holes 51*h* to flow into the second connection pipe 52, are formed in the outer peripheral surface of the second connection pipe 52 that faces the second expansion chamber S2; the first connection pipe 51 and the second connection pipe 52 are arranged such that they are partially parallel to each other; and the first outer periphery connection holes 51*h* are arranged closer to the exhaust outlet 52*e* side than the second outer periphery connection holes 52*h*.

According to this configuration, the first connection pipe 51 and the second connection pipe 52 are arranged such that they are partially parallel to each other. Hence, increase in the longitudinal length of the muffler 50 can be avoided, as compared to a configuration where a single conduit extends in the longitudinal direction from the exhaust pipe side to the exhaust outlet side. Therefore, the muffler 50 can be downsized. Additionally, the first outer periphery connection holes 51*h* are arranged closer to the exhaust outlet 52*e* side than the second outer periphery connection holes 52*h*. Since the exhaust gas having flowed out to the inside of the expansion chamber S through the first outer periphery connection holes 51*h*, has inertia to flow to the exhaust outlet 52*e* side, the exhaust gas having flowed out to the inside of the expansion chamber S is more likely to remain inside the expansion chamber S. Hence, exhaust gas can be mixed sufficiently, and the exhaust noise-deadening effect can be fully exerted. Accordingly, the muffler 50 can be downsized, and its exhaust noise-deadening effect can be fully exerted.

Also, the partition wall 54 divides the expansion chamber S into the first expansion chamber S1 on the exhaust pipe 40 side, and the second expansion chamber S2 on the exhaust outlet 52*e* side; and the first connection pipe 51 is arranged so as to penetrate the partition wall 54, and extend to the second expansion chamber S2 side from inside the first expansion chamber S1. Since exhaust gas can be mixed in both of the first expansion chamber S1 and the second expansion chamber S2, exhaust noise can be deadened more effectively, as compared to a configuration including only a single expansion chamber.

Also, the second connection pipe 52 is arranged so as to extend to the exhaust outlet 52*e* side from the partition wall 54, inside the second expansion chamber S2. Hence, increase in the longitudinal length of the muffler 50 inside the second expansion chamber S2 can be avoided, so that the muffler 50 can be downsized. Also, downsizing of the muffler 50 inside the second expansion chamber S2 makes it easier to ensure capacity of the first expansion chamber S1. Therefore, the exhaust gas having flowed out to the inside of the first expansion chamber S1 from the exhaust pipe 40 is more likely to remain inside the first expansion chamber S1, exhaust gas can be mixed sufficiently, and exhaust noise can be deadened effectively.

Also, in the above embodiment, the end part of the second connection pipe 52 on the exhaust pipe 40 side is pressed against the partition wall 54; and the third connection holes 56*h*, which allow the exhaust gas having flowed out to the first expansion chamber S1 from the exhaust pipe 40 to flow into the second connection pipe 52, are formed in the partition wall 54. Hence, the exhaust gas having flowed into the second connection pipe 52 through the third connection holes 56*h*, and the exhaust gas having flowed into the second connection pipe 52 through the second outer periphery connection holes 52*h* are allowed to interfere with each other, so that exhaust noise can be deadened effectively.

Also, in the above embodiment, the first opening 51*u* of the first connection pipe 51 allows the exhaust gas having flowed out to the first expansion chamber S1 from the exhaust pipe 40 to flow into the first connection pipe 51; and the first opening 51*u* is arranged closer to the exhaust pipe 40 side than the third connection holes 56*h*. Hence, the exhaust gas having flowed out to the inside of the first expansion chamber S1 from the exhaust pipe 40 is more likely to flow into the first opening 51*u* than into the third connection holes 56*h*. Also, since the first outer periphery connection holes 51*h* are arranged in the second expansion chamber S2, the exhaust gas having flowed into the first opening 51*u* passes through the first connection pipe 51, and flows out to the second expansion chamber S2 through the first outer periphery connection holes 51*h*. Accordingly, exhaust gas can be mixed sufficiently by using the second expansion chamber S2 effectively, and exhaust noise can be deadened effectively.

Also, in the above embodiment, the lid member 53, which closes the second opening 51*e* of the first connection pipe 51 at a position closer to the exhaust outlet 52*e* side than the first outer periphery connection holes 51*h*, is provided in the end part of the first connection pipe 51 on the exhaust outlet 52*e* side. Hence, the exhaust gas having flowed into the first connection pipe 51 from the exhaust pipe 40 flows out to the second expansion chamber S2, while passing through only the first outer periphery connection holes 51*h*. Accordingly, exhaust gas can be mixed sufficiently by using the second expansion chamber S2 effectively, and exhaust noise can be deadened effectively.

Also, in the above embodiment, the first connection pipe 51 and the second connection pipe 52 have cylindrical shapes, and the inner diameter D1 of the first connection pipe 51 is smaller than the inner diameter D2 of the second connection pipe 52. Hence, the flow speed of exhaust gas flowing through the first connection pipe 51 can be made faster than a case where the inner diameter D1 of the first connection pipe 51 is larger than the inner diameter D2 of the second connection pipe 52. Therefore, the exhaust gas having flowed into the first connection pipe 51 from the exhaust pipe 40 is more likely to flow out to the second expansion chamber S2 through the first outer periphery connection holes 51*h*. Accordingly, exhaust gas can be mixed sufficiently by using the second expansion chamber S2 effectively, and exhaust noise can be deadened effectively. Note that although a similar noise deadening-effect can be achieved when the inner diameter D1 of the first connection pipe 51 is the same as the inner diameter D2 of the second connection pipe 52, a more prominent effect can be achieved when the inner diameter D1 of the first connection pipe 51 is smaller than the inner diameter D2 of the second connection pipe 52.

In the above embodiment, the opening area of the third connection holes 56*h* is smaller than the opening area of the first opening 51*u*. Hence, the exhaust gas having flowed into the first connection pipe 51 from the exhaust pipe 40 is less likely to flow into the third connection holes 56*h*, as compared to a case where the opening area of the third connection holes 56*h* is larger than the opening area of the first opening 51*u*. For this reason, the exhaust gas having flowed into the first connection pipe 51 from the exhaust pipe 40 is more likely to flow into the first connection pipe 51, and flow out to the second expansion chamber S2 through the first outer periphery connection holes 51*h*. Accordingly, exhaust gas can be mixed sufficiently by using the second expansion chamber S2 effectively, and exhaust noise can be deadened effectively. Note that although a similar noise deadening-effect can be achieved when the opening area of the third connection holes 56*h* is the same as the opening area of the first opening 51*u*, a more prominent effect can be achieved when the opening area of the third connection holes 56*h* is smaller than the opening area of the first opening 51*u*.

Also, in the above embodiment, the opening area E2 of second outer periphery connection holes 52*h* is smaller than the opening area E1 of first outer periphery connection holes 51*h*. Hence, the exhaust gas having flowed out to the second expansion chamber S2 through the first outer periphery connection holes 51*h* is less likely to flow into the second connection pipe 52, as compared to a case where the opening area E2 of second outer periphery connection holes 52*h* is larger than the opening area E1 of first outer periphery connection holes 51*h*. Therefore, the exhaust gas having flowed out to the inside of the second expansion chamber S2 is more likely to remain inside the second expansion chamber S2. Accordingly, exhaust gas can be mixed sufficiently by using the second expansion chamber S2 effectively, and exhaust noise can be deadened effectively. Note that although a similar noise deadening-effect can be achieved when the opening area E2 of second outer periphery connection holes 52*h* is the same as the opening area E1 of first outer periphery connection holes 51*h*, a more prominent effect can be achieved when the opening area E2 of second outer periphery connection holes 52*h* is smaller than the opening area E1 of first outer periphery connection holes 51*h*.

Note that although the above embodiment has been described by using, as an example, the configuration in which the expansion chamber S is divided into the two expansion chambers S1, S2 by the partition wall 54, the invention is not limited to this. For example, just one expansion chamber may be provided, or the expansion chamber may be divided into three or more expansion chambers by adding partition walls.

Also, although the above embodiment has been described by using, as an example, the configuration in which the second connection pipe 52 is arranged parallel to the second piping 51*b*, the invention is not limited to this. For example, the second connection pipe 52 may be arranged parallel to the first piping 51*a*, or the second connection pipe 52 may be arranged parallel to the first connection pipe 51 (both of the first piping 51*a* and the second piping 51*b*). That is, it suffices that the first connection pipe 51 and the second connection pipe 52 be arranged at least partially parallel to each other.

Also, although the above embodiment has been described by using, as an example, the configuration in which multiple first outer periphery connection holes 51*h* and second outer periphery connection holes 52*h* are formed, the invention is not limited to this. For example, just one each of the first outer periphery connection hole 51*h* and second outer periphery connection hole 52*h* may be formed.

Also, the first outer periphery connection holes 51*h* and the second outer periphery connection holes 52*h* are not limited to punched holes, but may be formed into a slits or a mesh pattern.

Note that the present invention is not limited to the above embodiment. For example, the exhaust system includes general exhaust systems of a motorcycle, and includes not only configurations in which the muffler is arranged on left and right sides of the rear wheel, but also configurations in which the muffler is arranged only on the left or right side of the rear wheel.

Also, the vehicle includes general vehicles that the rider rides by straddling the vehicle body, and includes not only a motorcycle (including a motorized bicycle and a scooter type vehicle), but also three-wheeled (including vehicles two-wheeled at the front and one-wheeled at the rear, as well as those one-wheeled at the front and two-wheeled at the rear) or four-wheeled vehicles. Also, not only vehicles using a carburetor, but also vehicles using a fuel injection device are included.

The configuration of the above embodiment is one example of the present invention, and various modifications, such as replacing a component of the embodiment with a known component, can be made, without departing from the gist of the invention.

What is claimed is:

1. An exhaust system comprising a muffler, which is connected to an exhaust pipe guiding exhaust gas of an engine, and which extends from said exhaust pipe side to the side of an exhaust outlet discharging said exhaust gas to the outside, said muffler including a tube, which extends between said exhaust pipe side and said exhaust outlet side, and in which an expansion chamber is formed, wherein:

said muffler further includes a partition wall for partitioning the inside of said tube;

said partition wall divides said expansion chamber into a first expansion chamber on said exhaust pipe side, and a second expansion chamber on said exhaust outlet side;

said muffler further includes a first connection pipe, which is arranged so as to penetrate said partition wall and extend to said second expansion chamber side from inside said first expansion chamber, and a second connection pipe, which is arranged so as to extend to said exhaust outlet side from said partition wall inside said second expansion chamber;

a first outer periphery connection hole, which allows said exhaust gas from said exhaust pipe to flow out to said second expansion chamber, is formed in the outer peripheral surface of said first connection pipe that faces said second expansion chamber;

a second outer periphery connection hole, which allows said exhaust gas having flowed out to said second expansion chamber through said first outer periphery connection hole to flow into said second connection pipe, is formed in the outer peripheral surface of said second connection pipe that faces said second expansion chamber;

said first connection pipe and said second connection pipe are arranged such that they are at least partially parallel to each other;

said first outer periphery connection hole is arranged closer to said exhaust outlet side than said second outer periphery connection hole; and an opening area of said second outer periphery connection hole is smaller than an opening area of said first outer periphery connection hole.

2. The exhaust system according to claim 1, wherein:

an end part of said second connection pipe on said exhaust pipe side is pressed against said partition wall;

a third connection hole, which allows said exhaust gas having flowed out to said first expansion chamber from said exhaust pipe to flow into said second connection pipe, is formed in said partition wall; and said second connection pipe is configured to allow said exhaust gas having flowed into said second connection pipe through said third connection holes, and said exhaust gas having flowed into said second connection pipe through said second outer periphery connection hole interfere with each other.

3. The exhaust system according to claim 2, wherein:

a distal aperture of said first connection pipe on said exhaust pipe side, allows said exhaust gas having flowed out to said first expansion chamber from said exhaust pipe to flow into said first connection pipe;

said distal aperture is arranged closer to said exhaust pipe side than said third connection hole; and said first outer periphery connection hole is arranged in said second expansion chamber.

4. The exhaust system, according to claim 1, wherein a lid member, which closes a distal aperture of said first connection pipe on said exhaust outlet side, at a position closer to said exhaust outlet side than said first outer periphery connection hole, is provided in an end part of said first connection pipe on said exhaust outlet side.

5. The exhaust system according to claim 1, wherein:

said first connection pipe and said second connection pipe have cylindrical shapes; and an inner diameter of said first connection pipe is the same or smaller than an inner diameter of said second connection pipe.

* * * * *